US012392158B2

(12) United States Patent
Tan et al.

(10) Patent No.: US 12,392,158 B2
(45) Date of Patent: Aug. 19, 2025

(54) SELF-RESETTING BUCKLING-RESTRAINED BRACE AND ENERGY CONSUMPTION METHOD THEREFOR

(71) Applicant: Guangzhou University, Guangzhou (CN)

(72) Inventors: Ping Tan, Guangzhou (CN); Xiaofeng Zhao, Guangzhou (CN); Yang Li, Guangzhou (CN); Lin Chen, Guangzhou (CN); Yaoqiu Long, Guangzhou (CN); Fulin Zhou, Guangzhou (CN)

(73) Assignee: GUANGZHOU UNIVERSITY, Guangdong (CN)

( * ) Notice: Subject to any disclaimer, the term of this patent is extended or adjusted under 35 U.S.C. 154(b) by 0 days.

(21) Appl. No.: 18/021,850

(22) PCT Filed: Aug. 16, 2021

(86) PCT No.: PCT/CN2021/112766
§ 371 (c)(1),
(2) Date: Feb. 17, 2023

(87) PCT Pub. No.: WO2022/037530
PCT Pub. Date: Feb. 24, 2022

(65) Prior Publication Data

US 2024/0271452 A1 Aug. 15, 2024

(30) Foreign Application Priority Data

Aug. 18, 2020 (CN) ..... 202010830355.9

(51) Int. Cl.
*E04B 1/98* (2006.01)
*E04H 9/02* (2006.01)

(52) U.S. Cl.
CPC ..... *E04H 9/0237* (2020.05); *E04H 9/021* (2013.01); *E04B 1/98* (2013.01); *E04H 9/024* (2013.01)

(58) Field of Classification Search
None
See application file for complete search history.

(56) References Cited

U.S. PATENT DOCUMENTS 5,790,388 A * 8/1998 Buckingham ..... E04H 9/021 174/42
2018/0283487 A1* 10/2018 Hattori ..... G02B 23/16
2019/0315595 A1* 10/2019 Hattori ..... B66B 9/187

FOREIGN PATENT DOCUMENTS

CN 103981968 A 8/2014
CN 106760010 A 5/2017
(Continued)

OTHER PUBLICATIONS

International Search Report dated Nov. 12, 2021, Application No. PCT/CN2021/112766.

*Primary Examiner* — Phi D A
*Assistant Examiner* — Phi D Tran
(74) *Attorney, Agent, or Firm* — The Dobrusin Law Firm, P.C.; Alexandria J. Janda

(57) ABSTRACT

The invention relates to a self-resetting buckling-restrained brace, comprising a central positioning plate and secondary buckling-restrained units located on the left and right sides; the secondary buckling-restrained units each comprise a connection node, a brace core component, an outer sleeve steel pipe, a sliding load-bearing plate, a fixed load-bearing plate, a stabilization steel bar, steel frame braces, a Belleville spring and friction plates; the brace core component, the sliding load-bearing plate and the stabilization steel bar are connected in order and slide into the outer sleeve steel pipe; the middle portion of the brace core component penetrates
(Continued)

through the outer sleeve steel pipe, and the outer end of the brace core component is fixedly connected to the connection node; the fixed load-bearing plate, the steel frame braces and the central positioning plate are connected in order, and an inner end of the stabilization steel bar penetrates through the fixed load-bearing plate; the friction plates in contact with the stabilization steel bar are provided between the fixed load-bearing plate and the central positioning plate; and the compressed Belleville spring is sleeved outside the stabilization steel bar. The present invention further relates to an energy consumption method by using the self-resetting buckling-restrained brace. The present invention has a simple structure, increases the bearing capacity of the main body structure, has a self-resetting capability, and belongs to the technical field of energy-consumption damping structures for buildings.

10 Claims, 3 Drawing Sheets

(56) References Cited

FOREIGN PATENT DOCUMENTS

| | | | |
|---|---|---|---|
| CN | 208309874 | U | 1/2019 |
| CN | 109853770 | A | 6/2019 |
| CN | 110528946 | A | 12/2019 |
| CN | 111962703 | A | 11/2020 |
| CN | 212453166 | U | 2/2021 |
| WO | 2016130171 | A1 | 8/2016 |

* cited by examiner

SELF-RESETTING BUCKLING-RESTRAINED BRACE AND ENERGY CONSUMPTION METHOD THEREFOR

FIELD OF THE INVENTION

The present disclosure relates to an energy-consumption damping structure of a building, in particular, to a self-resetting buckling-restrained brace and an energy-consumption method by using the self-resetting buckling-restrained brace.

BACKGROUND OF THE INVENTION

As industrialized cities have developed in China and modernization is a necessity, the design of modern engineering structures has become increasingly concerned with reducing damage to people and properties caused by the destruction of buildings during an earthquake due to the recent frequent seismic activity in the country.

At present, for the seismic resistance of a building structure, measures of increasing the structural damping and arranging isolation layers are usually taken to consume the earthquake energy applied to the structure. A traditional buckling-restrained brace component is mainly composed of an internal core material, an external restraining component, an unbonded expandable material, and an unbonded sliding interface, and has the functions of both ordinary steel brace and metal energy-consumption damper. Buckling-restrained braces can buckle after a strong earthquake, which significantly reduces the main body structure's seismic damage and has excellent energy consumption capacity and ductility.

There is obvious yield deformation in traditional buckling-restrained braces, but the beam-column joints in the entire structure remain elastic, allowing the buckling-restrained brace component to provide effective lateral resistance.

Due to the high yield-bearing capacity of the traditional buckling-restrained brace, it cannot buckle in time when a small earthquake occurs, and cannot dissipate energy. Furthermore, the rigidity of the brace decreases rapidly after buckling.

Therefore, it is very necessary to develop an anti-buckling bracing device that can not only consume seismic energy during an earthquake but also provide the self-resetting capability. In order to improve structural safety, it is extremely important to prevent damage and residual deformation caused by the failure of the support member before the beam-column joint. At the same time, the brace can improve the disaster resistance of the structure and reduce the post-disaster repair cost of the damaged building.

SUMMARY OF THE INVENTION

In view of the problems in the prior art, the present disclosure proposes a self-resetting buckling-restrained brace that can effectively consume earthquake energy and has a self-resetting capacity. The present disclosure also proposes a method for energy consumption by using the self-resetting buckling-restrained brace.

To achieve the foregoing purposes, the present disclosure adopts the following technical solution:

A self-resetting buckling-restrained brace is provided. The self-resetting buckling-restrained brace includes a central positioning plate and secondary buckling-restrained units located on the left and right sides of the central positioning plate; each of the second buckling-restrained units includes a connection node, a brace core component, an outer sleeve steel pipe, a sliding load-bearing plate, a fixed load-bearing plate, a stabilization steel bar, steel frame braces, a Belleville spring and friction plates; the outer sleeve steel pipe is fixed with the central positioning plate; the brace core component, the sliding load-bearing plate and the stabilization steel bar are connected in order from outside toward inside and slide as a whole into the outer sleeve steel pipe; a middle portion of the brace core component penetrates through the outer sleeve steel pipe, and an outer end of the brace core component is fixedly connected to the connection node; the fixed load-bearing plate, the steel frame braces and the central positioning plate are connected in order from outside toward inside, and the fixed load-bearing plate and the steel frame braces are located inside the outer sleeve steel pipe; an inner end of the stabilization steel bar penetrates through the fixed load-bearing plate; the friction plates in contact with the stabilization steel bar are provided between the fixed load-bearing plate and the central positioning plate; and the compressed Belleville spring is sleeved outside the stabilization steel bar and is located between the fixed load-bearing plate and the sliding load-bearing plate.

As a preferred embodiment, the two secondary buckling-restrained units have the same structure and are symmetrically arranged on the left and right of the central positioning plate; and the two secondary buckling-restrained units are arranged in an in-line form.

As a preferred embodiment, the brace core component is of a rod-like structure with a square cross-section; the outer sleeve steel pipe is a square pipe; the fixed load-bearing plate, the sliding load-bearing plate, and the central positioning plates all have square cross-sections; and the stabilization steel bar has a circular cross-section.

As a preferred embodiment, four steel frame braces are arranged around the stabilization steel bar in up, down, front and rear directions; four friction plates are arranged around the stabilization steel bar in the up, down, front and rear directions and are clung to the stabilization steel bar; and the friction plates have rectangular cross-sections.

As a preferred embodiment, each of the secondary buckling-restrained units further includes a limiting plate for restraining the sliding load-bearing plate from sliding outwards; and the limiting plate is fixed on an inner side wall of the outer sleeve steel pipe.

As a preferred embodiment, each of the secondary buckling-restrained units further includes two round limiting blocks, one of which is fixed on the inner side of the sliding load-bearing plate and the other one of which is fixed on the outer side of the fixed load-bearing plate; end portions of the Belleville spring are sleeved on the limiting blocks, and round holes for allowing the stabilization steel bar to pass are formed in the limiting blocks.

As a preferred embodiment, rigid connection is employed between each of the two components as follows: between the brace core component and the sliding load-bearing plate, between the fixed load-bearing plate and the steel frame braces, and between the steel frame braces and the central positioning plate.

As a preferred embodiment, a gusset plate is arranged on the main body structure, and the connection node and the gusset plate are connected through a high-strength bolt.

An energy consumption method by using the self-resetting buckling-restrained brace is provided. Energy is consumed by the interaction of the friction plates and the stabilization steel bars, and energy is consumed by the Belleville springs to improve the bearing capacity, and a self-resetting capacity is provided by the Belleville springs.

As a preferred embodiment, the corresponding self-resetting ability is provided according to the number and type of the Belleville springs, and the two secondary buckling-restrained units have equal bearing capacities.

The present disclosure has the following advantages:

On the premise of ensuring the original design of the main body structure as much as possible, the self-resetting buckling-restrained brace can increase the bearing capacity of the main body structure. At the same time, corresponding self-resetting capacity can be provided to the brace depending on the number and type of the Belleville springs on the left and right sides. The length of the brace core component on the left side is the same as that of the brace core component on the right side, and the bearing capacity of the secondary buckling-restrained unit on the left side is the same as that of the secondary buckling-restrained unit on the right side. In such a way, when an earthquake occurs, the Belleville springs in the brace are in a compressed or tensioned state, thereby consuming the energy input from the earthquake, functioning as a brace, protecting the entire structure from being damaged, reducing post-earthquake residual deformation, reducing the repair cost on post-earthquake buildings, saving the cost in terms of labor and materials and financial budget of a country, and at the same time, shortening the time for post-earthquake rehabilitation. The self-resetting buckling-restrained brace has a simple structure, excellent construction convenience, and extremely high practical value.

The gap between the outer sleeve steel pipe and the brace core component is not filled with any material. When the Belleville springs are deformed, the stabilizing steel bar comes into contact with the friction plate. The component dissipates part of the received energy via friction, so that the bearing capacity of the brace is improved. The Belleville springs are used as the main energy consumption components, and the energy received by the brace component is consumed through the deformations of the Belleville springs. The self-resetting buckling-restrained brace not only can consume the earthquake energy in small or moderate earthquakes but also can reduce the damage and corresponding residual deformation of the main body structure in a great earthquake.

The rigid connection can ensure that the connection portions are in a stable and firm state.

The present disclosure not only can be widely used in frame structures, steel structures and high-rise structures, but also can be used in industrial buildings. The present disclosure solves the problem that the traditional buckling-restrained energy consumption brace cannot return to its initial state by itself in an earthquake.

Figure 1:
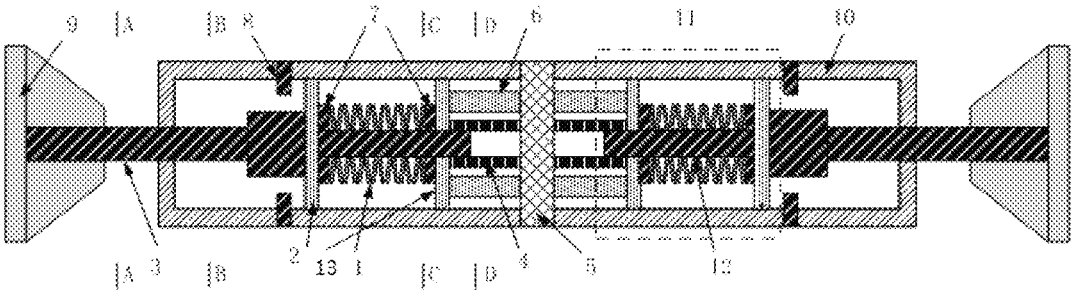
FIG. 1 is a schematic structural diagram of a self-resetting buckling-restrained brace.
Figure 2:
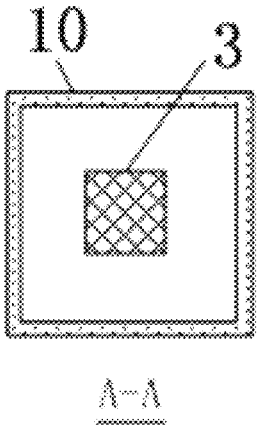
FIG. 2 is a sectional view of A-A in FIG. 1.
Figure 3:
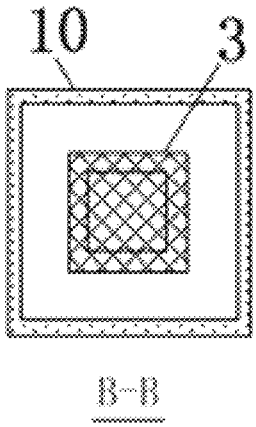
FIG. 3 is a sectional view of B-B in FIG. 1.
Figure 4:
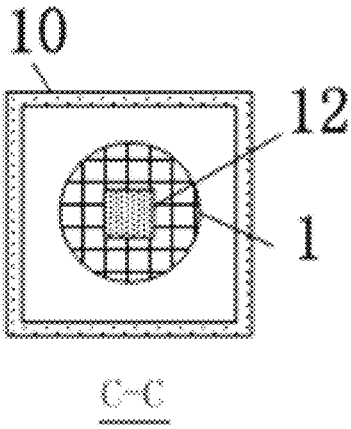
FIG. 4 is a sectional view of C-C in FIG. 1.
Figure 5:
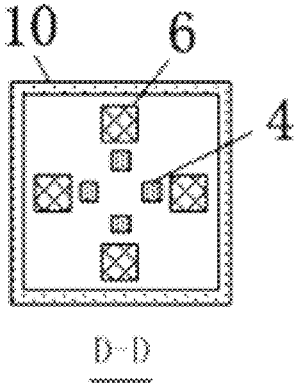
FIG. 5 is a sectional view of D-D in FIG. 1.
Figure 6:
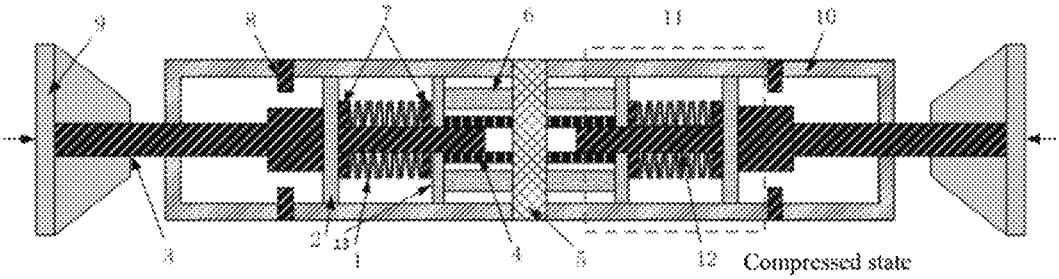
FIG. 6 is a diagram of a working state of a self-resetting buckling-restrained brace in an earthquake.
Figure 7:
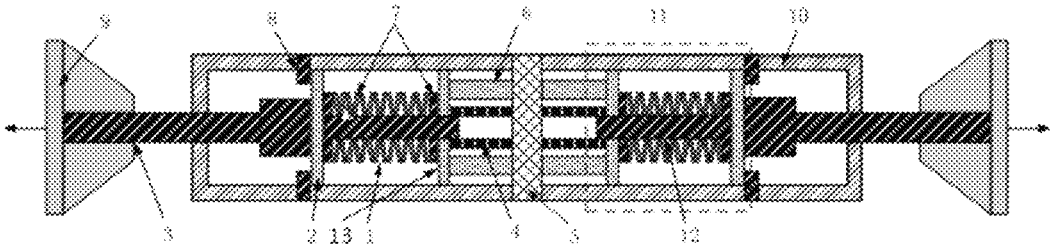
FIG. 7 is a diagram of a resetting state of a self-resetting buckling-restrained brace after an earthquake.

1: Belleville spring; 2: sliding load-bearing plate; 3: brace core component; 4: friction plate; 5: central positioning plate; 6: steel frame brace; 7: limiting block; 8: limiting plate; 9: connection node; 10: outer sleeve steel pipe; 11: self-resetting device; 12: stabilization steel bar; and 13: fixed load-bearing plate.

DETAILED DESCRIPTION OF THE EMBODIMENTS

The present disclosure is further described in detail below in combination with specific embodiments.

A self-resetting buckling-restrained brace is provided. The self-resetting buckling-restrained brace includes a central positioning plate and secondary buckling-restrained units located on the left and right sides of the central positioning plate, and is used for reducing the damage to beam-column joints in an earthquake and reducing the damage and residual deformation to the main body structure.

Each of the secondary buckling-restrained units includes a connection node, a brace core component, an outer sleeve steel pipe, a sliding load-bearing plate, a fixed load-bearing plate, a stabilization steel bar, steel frame braces, a Belleville spring, and friction plates. The outer sleeve steel pipe is fixed with the central positioning plate. The brace core component, the sliding load-bearing plate, and the stabilization steel bar are connected in order from outside toward inside and slide as a whole into the outer sleeve steel pipe. The middle portion of the brace core component penetrates through the outer sleeve steel pipe, and the outer end of the brace core component is fixedly connected to the connection node. The fixed load-bearing plate, the steel frame braces, and the central positioning plate are connected in order from outside toward inside, and the fixed load-bearing plate and the steel frame braces are located inside the outer sleeve steel pipe. An inner end of the stabilization steel bar penetrates through the fixed load-bearing plate. The friction plates in contact with the stabilization steel bar are provided between the fixed load-bearing plate and the central positioning plate. The compressed Belleville spring is sleeved outside the stabilization steel bar and is located between the fixed load-bearing plate and the sliding load-bearing plate.

To ensure the stability of axial deformation of the Belleville springs, the stabilization steel bar penetrates through each Belleville spring, and an enough space for sliding is reserved at the rear end. Furthermore, the limiting blocks are arranged at two ends of the stabilization steel bar such that the stabilization steel bar is prevented from laterally sliding. Such lateral sliding may affect the axial deformation of the Belleville spring, which reduces the energy consumption capacity of the brace. Meanwhile, depending on the requirement of the bearing capacity of the component, the corresponding limiting plate is provided, which prevents the Belleville spring from extending beyond the size of the original design due to the extremely high resetting capacity of the Belleville spring. The central positioning plate is welded with the outer sleeve steel pipe, which ensures a reliable connection between the central positioning plate and the outer sleeve steel pipe. In addition, the position of the limiting plate can be adjusted according to the design requirements.

The specification of the Belleville spring on the left and right sides directly affects the bearing capacity of the self-resetting buckling-restrained energy consumption brace. While the specifications (the cross-sectional areas and cross-sectional shapes) of the Belleville springs on the left and right sides can be designed according to actual requirements of a project, the Belleville springs should remain elastic in an earthquake, so that the Belleville springs consume the energy in a great earthquake by tension and compression and will not fail.

The central positioning plate is also a key portion to bear a load. The central positioning plate when being loaded is required to be connected to the outer sleeve steel pipe in a reliable way. And it should be ensured that no fracture failure between the central positioning plate and the outer sleeve steel pipe occurs under a great earthquake. Therefore, in actual use, the size of a positioning steel plate can be designed according to the performance requirements of the entire self-resetting buckling-restrained energy consumption brace, to ensure the mechanical properties of the left and right self-resetting devices and the whole brace.

A certain gap is reserved between the stabilization steel bar and the central positioning plate to ensure that when the connection node is subjected to an axial load, such load can be completely transmitted to an internal self-resetting device through the brace core component. The Belleville spring in the self-resetting device consumes the earthquake energy through continuous compression and tension, thereby reducing and lowering the damage and residual deformation to the main body structure.

The two secondary buckling-restrained units have the same structure and are symmetrically arranged on the left and right of the central positioning plate. The two secondary buckling-restrained units are arranged in an in-line form.

The brace core component is a rod-like structure with a square cross-section. The outer sleeve steel pipe is a square pipe. The fixed load-bearing plate, the sliding load-bearing plate, and the central positioning plates all have square cross-sections. The stabilization steel bar has a circular cross-section.

Four steel frame braces are arranged around the stabilization steel bar in up, down, front and rear directions. Four friction plates are arranged around the stabilization steel bar in the up, down, front and rear directions and are clung to the stabilization steel bar. The friction plate has a rectangular cross-section. Under an action of an axial compressive deformation, the stabilization steel bars are in contact with the friction plates at the rear end. Part of the energy is consumed by friction between the stabilization steel bars and the friction plates, improving the bearing capacity of the brace.

Each of the secondary buckling-restrained units further includes a limiting plate for restraining the sliding load-bearing plate from sliding outwards. The limiting plate is fixed on the inner side wall of the outer sleeve steel pipe.

Each of the secondary buckling-restrained units further includes two round limiting blocks, one of which is fixed on the inner side of the sliding load-bearing plate and the other one of which is fixed on the outer side of the fixed load-bearing plate. End portions of the Belleville spring are sleeved on the limiting blocks. Round holes for allowing the stabilization steel bar to pass through are formed in the limiting blocks.

Rigid connection, for example in a way of welding, is adopted between all of two components as follows: between the brace core component and the sliding load-bearing plate, between the fixed load-bearing plate and the steel frame braces, and between the steel frame braces and the central positioning plate. In this way, no tearing occurs under the action of an axial tensile force.

A gusset plate is arranged on the main body structure, and the connection node and the gusset plate are connected through a high-strength bolt. A specific connection way is as follows: The gusset plate is welded at a related portion (for example, at a beam-column joint). A bolt hole corresponding to the connection node is formed in the gusset plate. The gusset plate and the connection node are directly connected through a high-strength bolt.

An energy consumption method by using the self-resetting buckling-restrained brace is provided. Energy is consumed by the interaction of the friction plates and the stabilization steel bars, and energy is consumed by the Belleville springs to improve the bearing capacity, and a self-resetting capacity is provided by the Belleville springs. The corresponding self-resetting ability is provided according to the number and type of the Belleville springs, and the two secondary buckling-restrained units have equal bearing capacities.

The present disclosure can achieve the following advantageous effects: to prevent the entire energy consumption brace from buckling under a pressure, a steel pipe is sleeved outside a slotted steel plate, which increases the overall rigidity inside and outside a plane of the brace, thereby improving the overall stability of the energy consumption brace. The self-resetting buckling-restrained brace bears tension and compression loads through the internal self-resetting devices, and consumes the earthquake energy through the Belleville springs and the friction plates, to ensure that the internal core brace will not buckle in the earthquake. When the bearing capacity of the energy consumption brace is determined by the strength of the Belleville springs, the Belleville springs can be stretched and compressed under the tension and compression loads to fully dissipate the energy. A relatively long space for extension and retraction are reserved at the rear ends of the energy consumption brace core components, so that when the brace is compressed, the brace core components at both ends move close toward the middle under the pressure. At this time, the Belleville springs are in a compressed state, but the brace core components do not buckle. Under the action of a tensile force, the core components at the two ends of the energy consumption brace extend outwards, and the springs extend outwards along the central limiting components. Furthermore, the corresponding limiting blocks are arranged to ensure that the Belleville springs do not exceed their bearing ranges. In this way, under the action of repeated tension and compression loads, the Belleville springs are repeatedly in extension and retraction deformations. With the extension and retraction deformations of the Belleville springs, the central limiting components are in contact with the friction plates at the rear ends to consume the energy. In this way, the earthquake energy is consumed and the main body structure can be protected. After a local earthquake force disappears, the self-resetting buckling-restrained brace enables the components to return to its initial state through a restoring force provided by the Belleville springs. The present disclosure solves the problem that the traditional buckling-restrained energy consumption brace cannot be reset after an earthquake, and effectively reduces the structural damage and residual deformation of the entire structure in an earthquake. The self-resetting buckling-restrained energy consumption brace can be prefabricated in the factory, and the bolts can be installed on-site, which enables a fast construction and achieves energy saving and environmental protection effects. The present disclosure is applicable to frame structures, steel structures, and high-rise structure buildings, in particular to industrialized damping buildings.

The above embodiments are preferred implementations of the present disclosure, but the implementations of the present disclosure are not limited by the above embodiments, and any other changes, modifications, substitutions, combinations, and simplifications that are made without departing from the spiritual essence and principle of the present disclosure shall all be equivalent replacement methods, which all fall within the protection scope of the present disclosure.

The invention claimed is:

1. A self-resetting buckling-restrained brace, comprising: a central positioning plate and two secondary buckling-restrained units located on two sides of the central positioning plate, wherein each of the two secondary buckling-restrained units comprises:

a connection node configured to be connected to a main body structure;

a brace core component, wherein an outer end of the brace core component is fixedly connected to the connection node;

an outer sleeve steel member fixed with the central positioning place, wherein a middle portion of the brace core component penetrates through the outer sleeve steel member;

a slidable load-bearing plate that is connected to an inner end of the brace core component;

a fixed load-bearing plate located inside the outer sleeve member;

a stabilization steel bar, wherein an inner end of the stabilization steel bar penetrates through the fixed load-bearing plate;

one or more steel frame braces located inside the outer sleeve steel member;

a spring sleeving the stabilization steel bar and located between the fixed load-bearing plate and the slidable load-bearing plate; and one or more friction plates in contact with the stabilization steel bar and located between the fixed load-bearing place and the central positioning plate;

wherein the brace core component, the slidable load-bearing plate, and the stabilization steel bar are connected in order from outside toward inside and form a whole that is slidable within the outer sleeve steel member; and wherein the fixed load-bearing plate, the one or more steel frame braces, and the central positioning plate are connected in order from outside toward inside.

2. The self-resetting buckling-restrained brace according to claim 1, wherein the two secondary buckling-restrained units have the same structure and are symmetrically arranged on the two sides of the central positioning plate with respect to the central positioning plate, and the two secondary buckling-restrained units are arranged in an in-line form.

3. The self-resetting buckling-restrained brace according to claim 1, wherein the brace core component is a rod-shaped structure with a square cross-section; the outer sleeve steel member is a square pipe; the fixed loaded-bearing plate, the slideable load-bearing plate, and the central positioning plate each has a square cross-section; and the stabilization steel bar has a circular cross-section.

4. The self-resetting buckling-restrained brace according to claim 1, wherein four steel braces are arranged around the stabilization steel bar in up, down, front, and rear directions; four friction plates are arranged around the stabilization steel bar in the up, down, front, and rear directions and are clung to the stabilization steel bar; and each of the four friction plates have a rectangular cross-section.

5. The self-resetting buckling-restrained brace according to claim 1, wherein the each of the two secondary buckling-restrained units further comprises a limiting plate for restricting the slidable load-bearing plate from sliding outwards, and the limiting plate is fixed on an inner side wall of the outer sleeve steel member.

6. The self-resetting buckling-restrained brace according to claim 1, wherein the each of the two secondary buckling-restrained units further comprises two round limiting blocks, one of which is fixed on an inner side of the slidable load-bearing plate and the other is fixed on an outer side of the fixed load-bearing plate; end portions of spring sleeves are on the limiting blocks, and round holes for allowing the stabilization steel bar to pass through are formed in the limiting blocks.

7. The self-resetting buckling-restrained brace according to claim 1, wherein a rigid connection is adopted between the brace core component and the slidable load-bearing plate, between the fixed load-bearing plate and the one or more steel frame braces, and between the one or more steel frame braces and the central positioning plate.

8. The self-resetting buckling brace according to claim 1, wherein the connection node is configured to be connected to a gusset plate of the main body structure through a bolt.

9. An energy consumption method comprising:

providing the self-resetting buckling-restrained brace of claim 1;

consuming energy through interaction of the one or more friction plates and the stabilization steel bar;

consuming energy by the spring of each of the two secondary buckling-restrained units to improve the bearing capacity; and providing a self-resetting capacity by the spring of each of the two secondary buckling-restrained units.

10. The energy consumption method according to claim 2, further comprising:

equalizing bearing capacity of the two secondary buckling-restrained units by the self-resetting capacity provided by the spring of each of the two secondary buckling-restrained units.

* * * * *